US010907376B1

(12) United States Patent
Bonilla

(10) Patent No.: US 10,907,376 B1
(45) Date of Patent: Feb. 2, 2021

(54) SELF-BUILDING TOWER

(71) Applicant: Anthony J. Bonilla, Yonkers, NY (US)

(72) Inventor: Anthony J. Bonilla, Yonkers, NY (US)

( * ) Notice: Subject to any disclaimer, the term of this patent is extended or adjusted under 35 U.S.C. 154(b) by 0 days.

(21) Appl. No.: 16/718,486

(22) Filed: Dec. 18, 2019

(51) Int. Cl.
*E04H 12/34* (2006.01)
*E04C 3/04* (2006.01)

(52) U.S. Cl.
CPC ..... *E04H 12/344* (2013.01); *E04C 3/04* (2013.01); *E04C 2003/0486* (2013.01)

(58) Field of Classification Search
CPC .. E04C 3/04; E04C 2003/0486; E04H 12/344
See application file for complete search history.

(56) References Cited

U.S. PATENT DOCUMENTS 926,925 A * 7/1909 Carmony ..... E04H 12/34 52/123.1
1,588,295 A * 6/1926 Berman ..... E04G 1/34 182/102
2,661,082 A * 12/1953 Ziegler ..... E04H 12/185 52/108
3,494,593 A * 2/1970 Blagg ..... E21B 15/00 254/336
3,504,461 A * 4/1970 Copeland ..... B66F 9/065 52/123.1
3,614,993 A * 10/1971 Penso ..... E04G 5/007 182/16
3,684,056 A * 8/1972 Penso ..... E04G 5/007 182/19
3,751,863 A * 8/1973 Lyons ..... E04H 12/185 52/111
4,027,440 A * 6/1977 Hamblin ..... E04H 12/185 52/108
4,089,147 A * 5/1978 Bain ..... E04B 1/344 248/421
4,134,237 A * 1/1979 Armstrong ..... E04H 12/182 52/118
4,231,200 A * 11/1980 Henderson ..... E04H 12/182 182/19
4,452,337 A * 6/1984 Atzinger ..... E04G 5/00 182/121
4,651,480 A * 3/1987 Kramer ..... E04H 12/185 182/41
4,657,113 A * 4/1987 Costello ..... E04G 1/22 182/63.1
4,885,893 A * 12/1989 Wasterval, Jr. ..... E21B 15/00 52/745.18

(Continued)

*Primary Examiner* — James M Ference
(74) *Attorney, Agent, or Firm* — Goldstein Law Offices, P.C.

(57) ABSTRACT

A self-building tower comprising a plurality of tower sections adapted to be connected in a sequence to form a modular tower, and a tower feeding system having a feeder sleeve block. The feeder sleeve block is elevated above a horizontal surface by a support column, and has a feeder aperture which allows tower sections to be positioned between the feeder aperture to be fed upwardly through the feeder sleeve block. The feeder sleeve block supports the modular tower in a position perpendicular to the horizontal surface. The tower feeding system has a hoist mechanism for raising each tower section through the feeder aperture, allowing additional tower sections to be attached to the lowermost tower section in the sequence.

5 Claims, 17 Drawing Sheets

(56) References Cited

U.S. PATENT DOCUMENTS 4,920,710 A * 5/1990 Paine ..... E04H 12/185 52/108
5,423,158 A * 6/1995 Vora ..... E04H 12/34 52/121
5,490,364 A * 2/1996 Desai ..... E04H 12/28 52/121
6,301,841 B1 * 10/2001 Rhebergen ..... E04H 12/18 52/118
7,357,365 B2 * 4/2008 Colman ..... F16M 13/00 248/439
7,461,831 B2 * 12/2008 Mosley ..... E21B 7/023 254/277
7,828,086 B2 * 11/2010 Lesko ..... E21B 7/023 175/203
8,353,132 B1 * 1/2013 Vogt ..... E21B 15/00 52/123.1
8,646,240 B1 * 2/2014 Patrick ..... E21B 7/023 52/651.05
8,950,125 B2 * 2/2015 Kensinger ..... E04H 12/34 52/108
2002/0129567 A1 * 9/2002 Olsen ..... E04H 12/185 52/111
2003/0172599 A1 * 9/2003 Frink ..... E21B 15/003 52/116
2011/0182066 A1 * 7/2011 Webb ..... F21V 21/22 362/235
2012/0304553 A1 * 12/2012 Konduc ..... E04B 1/34384 52/112
2013/0081337 A1 * 4/2013 Zavitz ..... E04H 12/344 52/123.1
2013/0223964 A1 * 8/2013 Zheng ..... B66C 23/207 414/560
2013/0269268 A1 * 10/2013 Thiessen ..... E04B 1/3533 52/118
2013/0305632 A1 * 11/2013 Rivera, Sr. ..... E21B 7/02 52/117
2014/0259985 A1 * 9/2014 Petrello ..... E21B 15/00 52/115
2014/0262518 A1 * 9/2014 Reddy ..... E04H 12/344 175/57
2014/0262519 A1 * 9/2014 Petrello ..... E21B 15/00 175/57
2014/0262520 A1 * 9/2014 Petrello ..... E21B 19/00 175/57
2016/0123023 A1 * 5/2016 Becker ..... E04G 5/007 29/897.31
2018/0065833 A1 * 3/2018 Stoof ..... B66C 23/74
2019/0292804 A1 * 9/2019 Kensinger ..... E04H 12/182

* cited by examiner

SELF-BUILDING TOWER

TECHNICAL FIELD

The present disclosure relates generally to a portable tower for use within indoor and outdoor venues. More particularly, the present disclosure relates to a self-building tower which is constructed in place without external machinery.

BACKGROUND

Events held at indoor and outdoor venues, such as festivals, shows, musical performances, and gatherings of various kinds often require the construction of temporary structures such as pavilions, rigging for stage equipment, speakers, lighting, and various other constructs and assemblies, which are used for the duration of the event and disassembled at the event's conclusion. Towers are a key component of such structures. However, construction of these towers often requires heavy equipment such as cranes in order to lift the individual pieces of the tower, with the result that these towers require a much larger amount of space than the actual surface area occupied by the completed tower.

Conventional tower structures are typically assembled by adding new sections to the top of the tower, such as by using a combination of a crane and a climbing frame to lift new sections to the top of the tower for incorporation below the crane. Furthermore, when assembling towers inside an indoor venue, there may be insufficient height between the floor and the ceiling to allow for the operation of cranes. Other towers of relatively modest height may be constructed without cranes, but such towers are generally assembled horizontally on the ground before being raised to a vertical position through the use of machinery. This process requires significant amounts of space, and may disrupt construction of other nearby structures.

Other examples of towers include towers with collapsible sections which telescopically extend and retract. However such towers have only a predefined length and are thus limited in height.

A need therefore exists for a self-building tower which is constructed in a vertical manner by adding new tower sections to the bottom of the tower, thus minimizing the footprint occupied by the tower during its assembly.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a tower which can be assembled upon a horizontal surface with a minimal footprint. Accordingly, the present disclosure provides a self-building tower comprising a plurality of tower sections adapted to be connected in a sequence to form a modular tower, and a tower feeding system adapted to support the modular tower in a perpendicular position relative to the horizontal surface while the modular tower is being assembled. The tower feeding system has a feeder sleeve block which allows the tower sections to be fed upwardly into a feeder aperture until the modular tower is complete.

It is another aspect of an example embodiment in the present disclosure to provide a tower which can be assembled without the use of a crane or other external lifting machinery. Accordingly, the tower feeding system has an integral hoist mechanism which is adapted to raise and lower each tower section through the feeder aperture.

It is yet another aspect of an example embodiment in the present disclosure to provide a tower which minimizes the need to manually raise new tower sections for incorporation into the modular tower. Accordingly, the tower sections may be configured with hinged attachment points. An additional tower section is placed at an angle in relation to a preceding tower section in the sequence before creating a hinged connection between the hinged attachment points of the additional and the preceding tower sections. The preceding tower section is raised along with the additional tower section using the hoist mechanism. The additional tower section pivots about the horizontal connection until it is colinear with the preceding tower section and is perpendicular to the horizontal surface.

It is a further aspect of an example embodiment in the present disclosure to provide a tower which is capable of lifting loads without external equipment. Accordingly, a tower mounted hoist mechanism may be attached to the first tower section in the sequence after it is inserted into the feeder aperture and extends upwardly through the feeder sleeve block. The first tower section becomes the uppermost tower section once the tower is completed, and the tower mounted hoist mechanism allows loads to be raised by the self-building tower.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
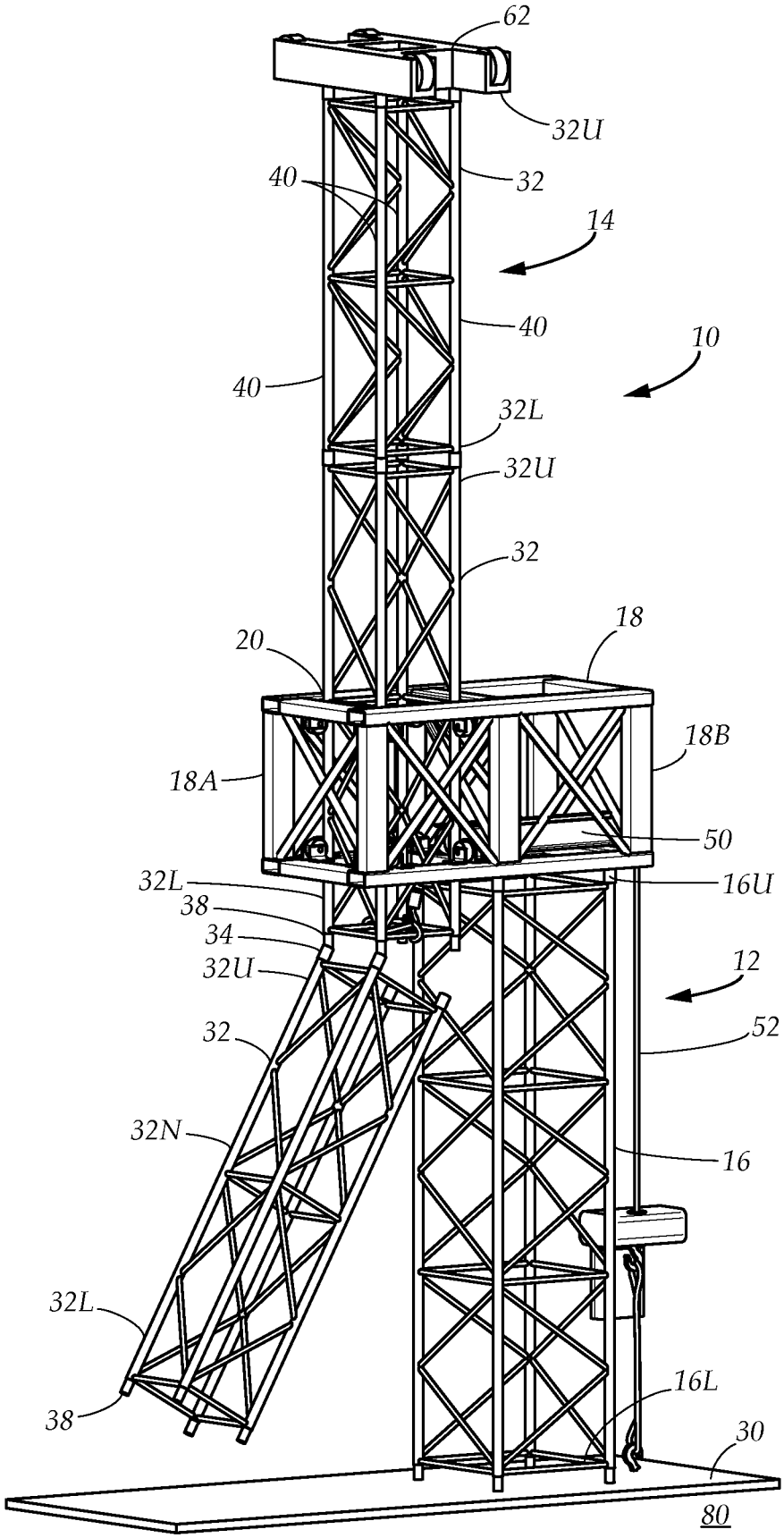
FIG. 1 is diagrammatical perspective view of a self-building tower comprising a tower feeding system attached to a tower base, and a modular tower formed using multiple tower sections which are fed upwardly through the tower feeding system, in accordance with an embodiment in the present disclosure.

FIG. 1 illustrates a self-building tower 10 comprising a tower feeding system 12, and a modular tower 14. The tower feeding system 12 rests upon a horizontal surface 80, and has a feeder sleeve block 18, which may be supported by a support column 16. In certain embodiments, the tower feeding system 12 may rest upon a tower base 30 which stabilizes the self-building tower 10 upon the horizontal surface 80. The modular tower 14 has a plurality of tower sections 32, whereby each of the tower sections 32 are adapted to be linked together sequentially to form the modular tower 14. The tower feeding system 12 is adapted to support the modular tower 14 as it is being assembled, while also allowing the tower sections 32 to be sequentially fed through the feeder sleeve block 18 for incorporation into the modular tower 14. The tower feeding system 12 further has a hoist mechanism 50 adapted to vertically lift and lower the tower sections 32 through the feeder sleeve block 18, allowing the modular tower 14 to be raised upwardly so that additional tower sections 32N may be incorporated.

Figure 4A:
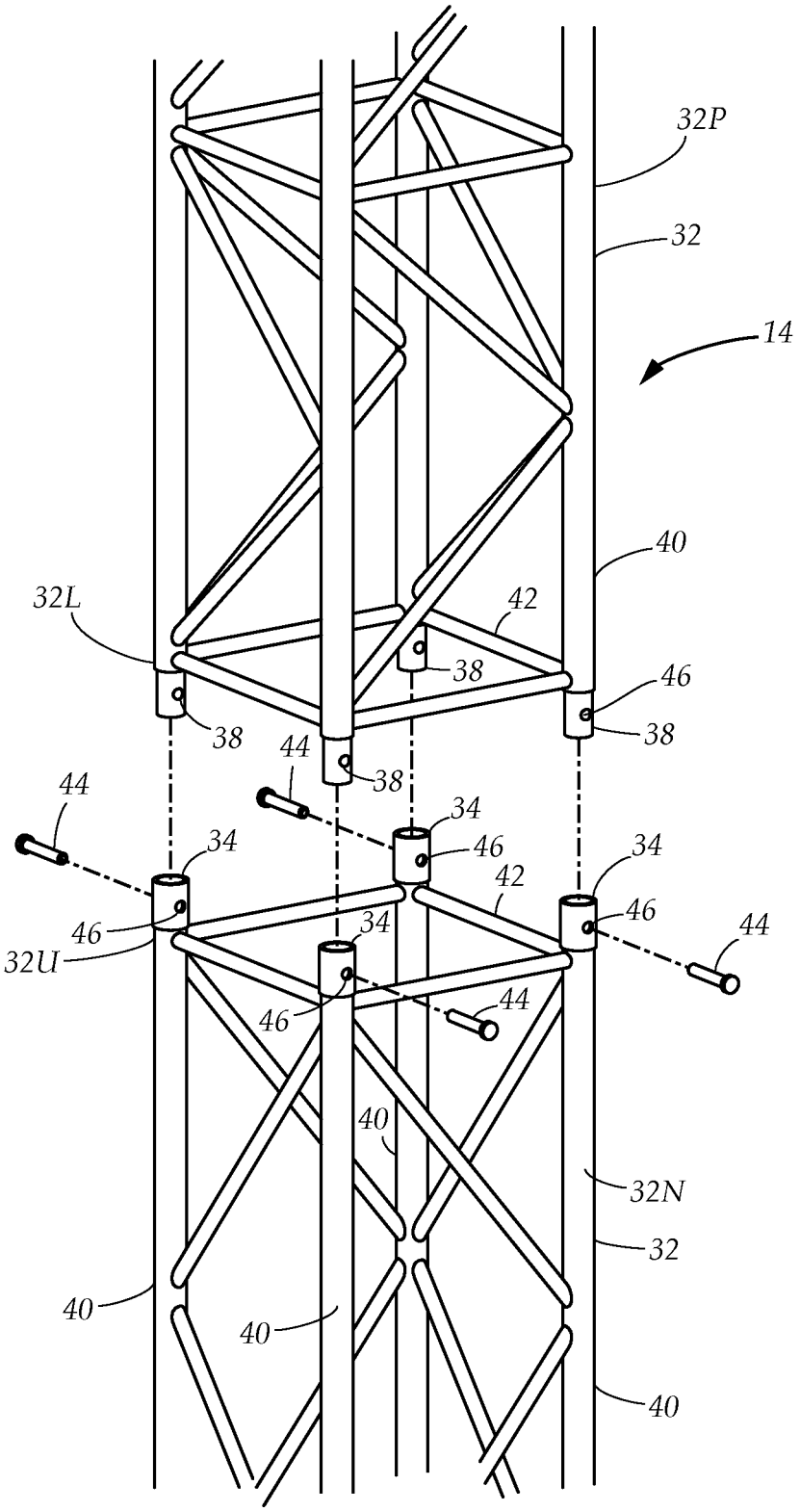
FIG. 4A is a diagrammatical perspective view detailing a plurality of upper and lower end attachment points for connecting two tower sections in sequence, in accordance with an embodiment in the present disclosure.

Referring to FIG. 4A while continuing to refer to FIG. 1, each tower section 32 is elongated and has a section upper end 32U and a distally disposed section lower end 32L. Furthermore, each tower section 32 has a plurality of upper end attachment points 34 extending from the section upper end 32U, and a plurality of lower end attachment points 38 extending from the section lower end 32L. In one embodiment, each tower section 32 also has a plurality of longitudinal frame members 40 which are arranged in parallel and extend between the section upper and lower ends 32U, 32L, and a plurality of lateral frame members 42 extending between the longitudinal frame members 40, forming a truss framework. In one embodiment, each tower section has four longitudinal frame members 40, giving the tower section 32 a rectangular cross sectional shape. The upper and lower end attachment points 34, 38 may be extensions of the longitudinal frame members 40. The modular tower 14 is assembled by joining the section lower end of one tower section 32 to the section upper end of a different tower section 32, such as by joining the lower end attachment points 38 with the upper end attachment points 34. In one embodiment, the lower end attachment points 38 are smaller than the upper end attachment points 34, allowing the upper end attachment points 34 to receive the lower end attachment points 38. The upper and lower end attachment points 34, 38 are held together by a fastening means. In a preferred embodiment attachment holes 46 are formed in each of the upper and lower attachment points 34, 38, and are aligned colinearly to allow attachment pins 44 to pass through, thus securing the lower end attachment points 38 within the upper end attachment points 34. Note that in an alternative embodiment, the upper end attachment points 34 may instead be smaller than the lower end attachment points 38, thus allowing the lower end attachment points 38 to receive the upper end attachment points 34.

The modular tower 14 can be assembled to reach any height by increasing the number of tower sections 32 which are sequentially joined together, as long as the hoist mechanism 50, the feeder sleeve block 18, and the support column 16 are sufficiently strong to handle the weight of the modular tower 14.

Once completed, the modular tower 14 stands perpendicular to the horizontal surface 80. The module tower 14 may be employed for event and stage rigging applications, mounting elevated cranes, supporting other structural elements, as well as other purposes as will be apparent to a person of ordinary skill in the art in the field of the invention. For example, a tower mounted hoist mechanism 62 may be attached to the section upper end 32U of the first and highest tower section 32, thus allowing loads to be raised towards the section upper end 32U of the uppermost tower section 32 within the modular tower 14. The tower mounted hoist mechanism 62 is adapted to lift loads and may be motorized or manually operated. Two or more self-building towers 10 outfitted with tower mounted hoist mechanisms 62 may be employed in combination to raise and support a horizontal structure, such as a horizontal truss, which spans the modular towers 14 making up the combination.

Figure 2:
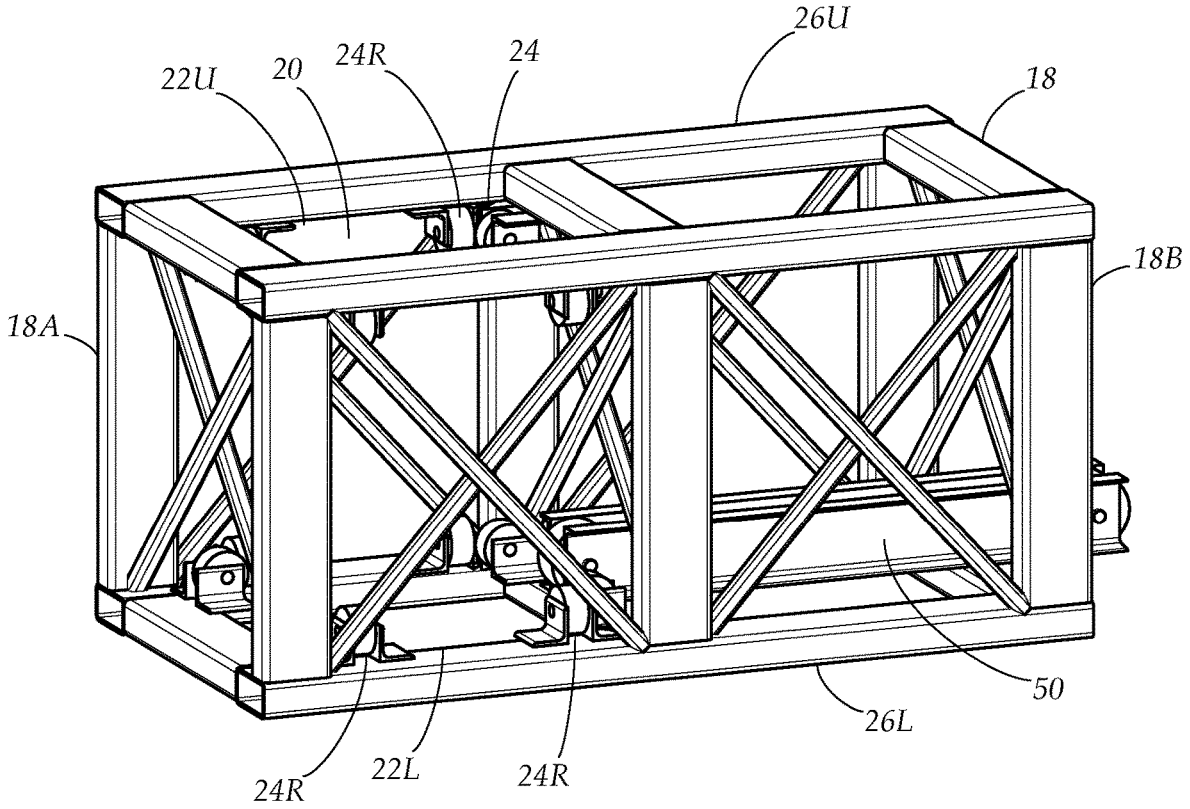
FIG. 2 is a diagrammatical perspective view of a feeder sleeve block, showing a feeder aperture and a hoist mechanism, in accordance with an embodiment in the present disclosure.
Figure 3:
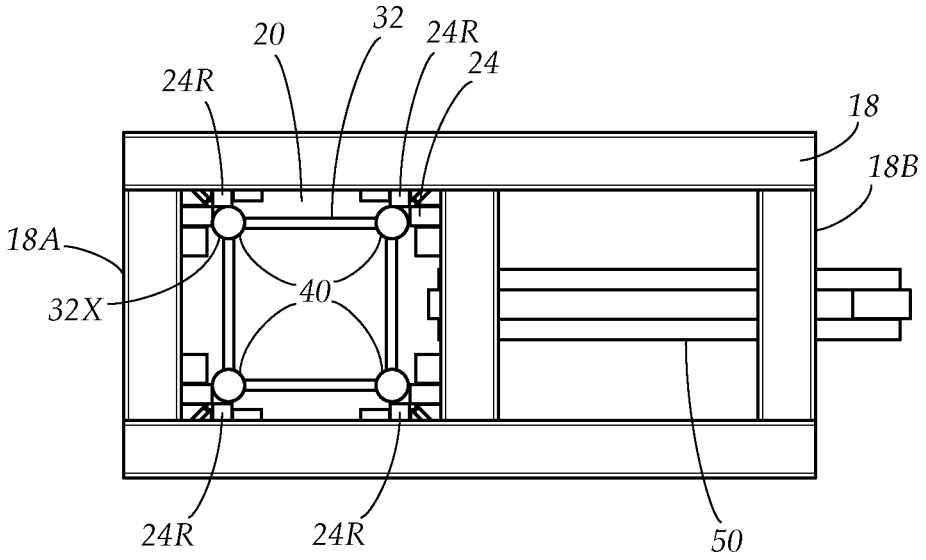
FIG. 3 is a diagrammatical top view of the feeder sleeve block, further showing a tower section positioned within the feeder aperture, the tower section being guided through the feeder aperture by a centering assembly, in accordance with an embodiment in the present disclosure.

Turning to FIGS. 2 and 3 while continuing to refer to FIG. 1, the feeder sleeve block 18 is held in an elevated position above the horizontal surface 80 by the support column 16. The feeder sleeve block 18 has a feeder aperture 20 which passes vertically through the feeder sleeve block 18 and has a lower opening 22L oriented downwardly, and an upper opening 22U oriented upwardly. The feeder aperture 20 has a cross sectional shape which matches the cross sectional shape of the tower sections 32, and is slightly larger than the tower sections 32, which allows the tower sections 32 to enter the feeder sleeve block 18 via the lower opening 22L, and pass upwardly through the upper opening 22U. Note that the number of longitudinal frame members 40 contained within the tower sections 32 may be increased or decreased depending on the cross sectional shape of the tower section 32. For example, each tower section 32 may have three longitudinal frame members 40, causing the tower section 32 to have a triangular sectional shape. In other embodiments, instead of having a truss configuration, the tower sections 32 may also be substantially solid, or be formed as hollow tubes or polygonal prisms with continuous sides or faces.

The feeder sleeve block 18 is also adapted to support the tower section 32 contained within the feeder aperture 20 in a consistently perpendicular position relative to the horizontal surface 80. In a preferred embodiment, the feeder sleeve block 18 has a centering assembly 24 positioned within the feeder aperture 20 which is adapted to engage and maintain the tower section 32 in a centered position. The centering assembly may have a plurality of guiding mechanisms 24R, such as rollers, which movably engage the exterior 32X of the tower sections 32 while also allowing the tower sections 32 to move vertically within the feeder aperture 20. In one embodiment, each of the guiding mechanisms 24R may be adapted to contact and engage one of the longitudinal frame members 40 of each tower section 32. For example, where the tower section 32 is formed as a rectangular truss, the feeder aperture 20 may be rectangular in shape and four guiding mechanisms 24R may be employed to engage the four longitudinal frame members 40. In other embodiments, the number of guiding mechanisms 24R may vary in accordance with the cross sectional shape of the tower sections 32 and the quantity of longitudinal frame members 40. Furthermore, the guiding mechanisms 24R may be positioned to movably engage tower sections 32 with corners or panels forming the tower section exteriors 32X.

Referring to FIGS. 1, 2, and 3, in one embodiment, the feeder sleeve block 18 may have a substantially rectangular shape, and has a sleeve block first end 18A, a distally oriented sleeve block second end 18B, a sleeve block upper portion 26U and a sleeve block lower portion 26L. The support column 16 has a support column lower end 16L which is attached to the horizontal surface 80 or the tower base 30, and a support column upper end 16U which projects upwardly. The sleeve block lower portion 26L may be attached to the support column upper end 16U at a point proximate to the sleeve block second end 18B, while the feeder aperture 20 is positioned proximate to the sleeve block first end 18 and passes through the feeder sleeve block 18 between the sleeve block upper and lower portions 26U, 26L. Note that in certain embodiments, the feeder sleeve block 18 may be attached to the support column 16 via the sleeve block second end 18B. The feeder sleeve block 18 may be separated from the tower base 30 or the horizontal surface 80 by a feeder sleeve height 28H (as shown in FIG. 5), as measured between the sleeve block lower portion 26L and the tower base 30 or the horizontal surface 80.

Figure 5:
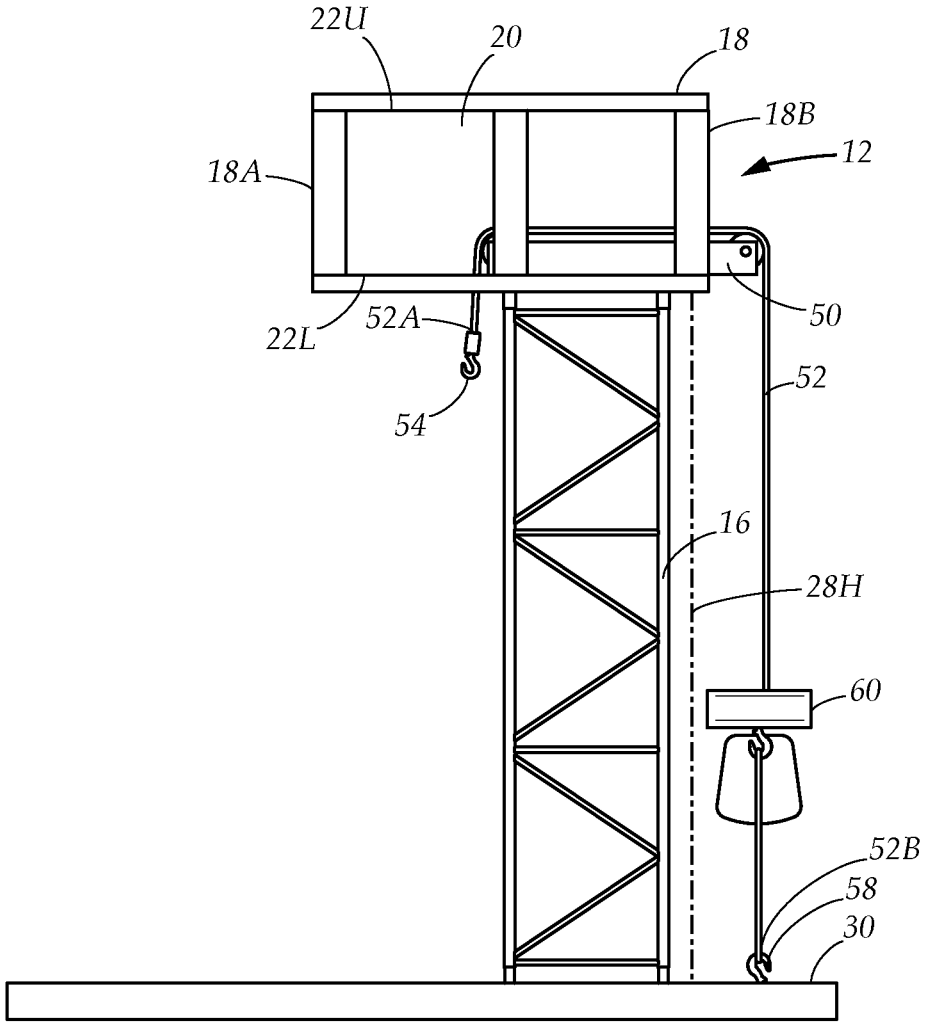
FIG. 5 is a diagrammatical side view of the tower feeding system, in accordance with an embodiment in the present disclosure

Turning to FIG. 5 while continuing to refer to FIGS. 1-3, the hoist mechanism 50 is adapted to pull a hoist line 52 having a hoist line first end 52A and a hoist line second end 52B. An attachment means 54, such as a hook, is connected to the hoist line first end 52A and is adapted to be selectively attachable to the tower sections 32. In a preferred embodiment, the hoist mechanism 50 is a chain motor, and the hoist line 52 is a chain. Alternatively, the hoist mechanism 50 may be any motor, winch, or a manually operated pulley system capable of extending and retracting the hoist line, and the hoist line 52 may be a cable, rope, or other suitable means which allows the hoist mechanism 50 to transfer force to the modular tower 14 in order to vertically raise or lower the modular tower 14. In one embodiment, the feeder sleeve block 18 is configured as an open truss, and the hoist mechanism 50 is positioned within the feeder sleeve block 18 proximate to the sleeve block second end 18B. The hoist line first end 52A and the attachment mechanism 54 project from the hoist mechanism 50 through the feeder aperture 20, and may be suspended below the lower opening 22L of the feeder aperture 20. The hoist line second end 52B may project beyond the sleeve block second end 18B, and may also be secured to a hoist line anchor point 58 positioned on the tower base 30. The hoist line second end 52B may also be attached to a counterweight 60. Note that the hoist mechanism 50 may be positioned in alternate locations within the tower feeding system 12. For example, the hoist mechanism 50 may be positioned on the support column 16, while one or more pulleys allow the hoist line 52 to operably extend through the feeder sleeve block 18 to reach the feeder aperture 20.

Figure 6:
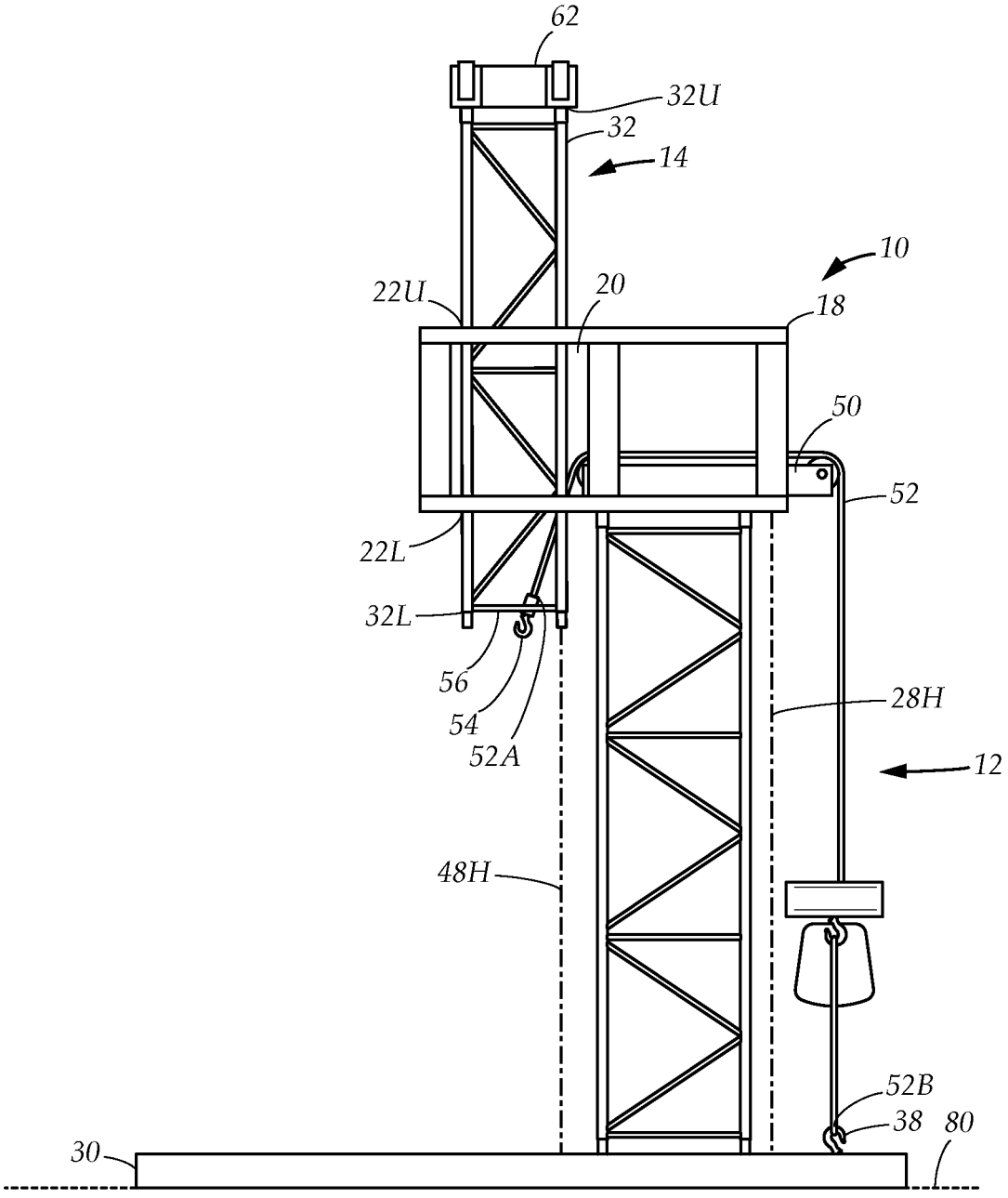
FIG. 6 is a diagrammatical side view of the tower feeding system, showing the first tower section in the sequence being suspended within the feeder aperture, in accordance with an embodiment in the present disclosure.

Turning now to FIG. 6 while also referring to FIGS. 4A and 5, assembly of the modular tower 14 begins by first feeding one of the tower sections 32 upwardly through the feeder aperture 20. The section upper end 32U of each tower section 32 may be aligned with the lower opening 22L and be lifted upwardly to enter the feeder aperture 20 through the lower opening 22L before eventually passing through the upper opening 22U. The tower section 32 may be first placed in a standing position upon a supporting surface such as the tower base 30 or the horizontal surface 80, allowing the attachment mechanism 54 to be secured to the tower section 32. The attachment mechanism 54 may be secured to an attachment point 56 on the tower section 32, such as a lateral frame member 42. Once the attachment mechanism 54 has been secured, the hoist mechanism 50 is activated to raise the tower section 32 upwardly through the feeder aperture 20. Note that when the tower mounted hoist mechanism 62 is employed, the tower mounted hoist mechanism 62 may be attached to the section upper end 32U of the first tower section 32 after it has been fed through the feeder sleeve block 18, to prevent the tower mounted hoist mechanism 62 from obstructing the feeder aperture 20. Note that in certain embodiments, the supporting surface may be a stand, block, or other suitable object or surface capable of supporting the tower sections 32 which form the modular tower 14.

Figure 7:
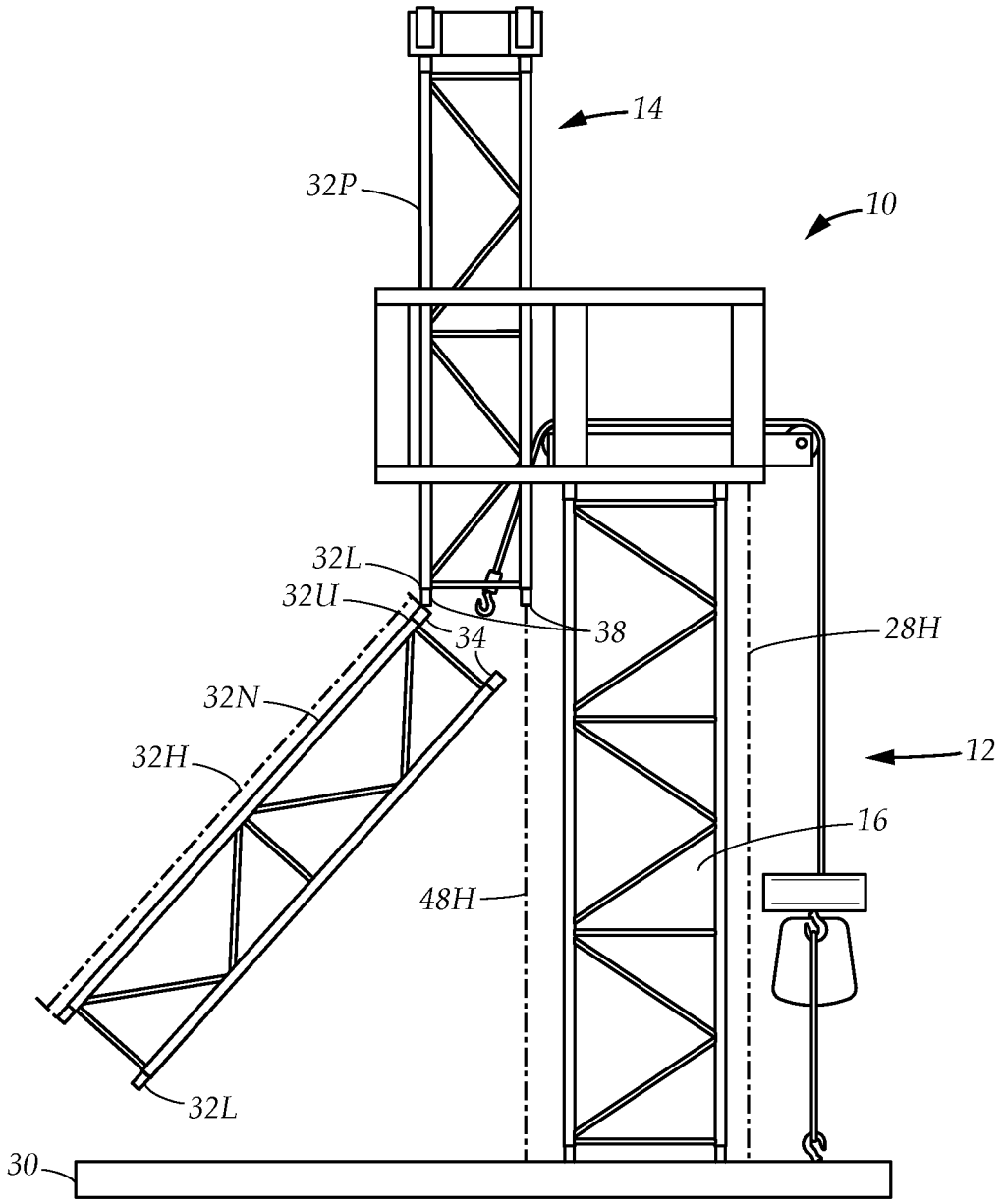
FIG. 7 is a diagrammatical side view of the tower feeding system, showing an additional tower section being attached to the preceding tower section, in accordance with an embodiment in the present disclosure.
Figure 8:
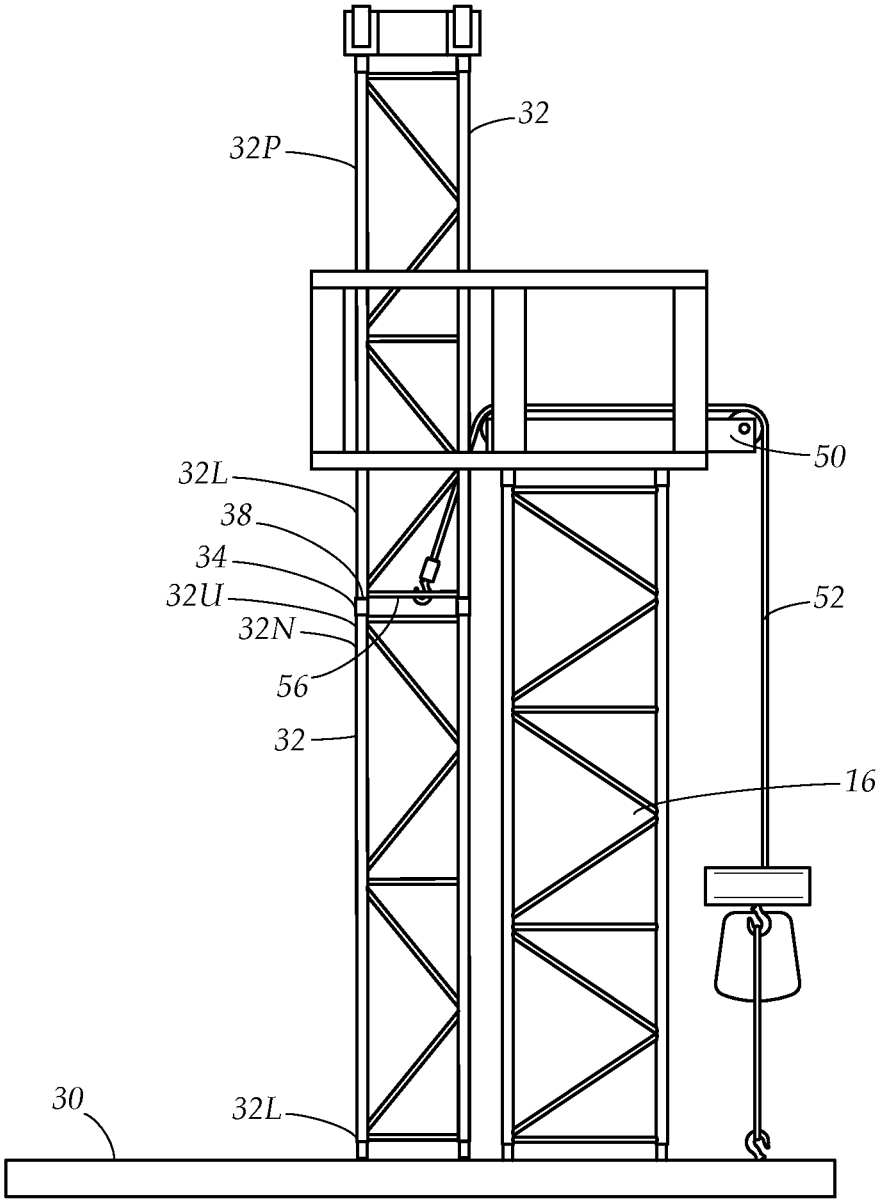
FIG. 8 is a diagrammatical side view of the tower feeding system, showing the modular tower in a grounded position, in accordance with an embodiment in the present disclosure.

Referring now to FIG. 7-8 while also referring to FIGS. 4A-5, once each tower section 32 has been raised, the hoist mechanism 50 allows the tower section 32 to remain temporarily fixed within the feeder aperture 20 such that the section lower end 32L extends downwardly through the lower opening 22L, thus placing the modular tower 14 in a suspended position. The tower section 32 which is so suspended may be referred to as a preceding tower section 32P. Another tower section 32 may then be attached to the section lower end 32L of the preceding tower section 32P while the modular tower 14 is in the suspended position, with this new tower section 32 being referred to as an additional tower section 32N. The preceding tower section 32P is generally also the lowermost tower section 32 in the sequence until the attaching of the additional tower section 32N. In one embodiment, the additional tower section 32N may be positioned below the preceding tower section 32P, with the upper end attachment points 34 of the additional tower section 32N placed in alignment with the lower end attachment points 38 of the preceding tower section 32P. The additional tower section 32N may be lifted upwardly to engage with the section lower end 32L of the preceding tower section 32P.

Figure 9:
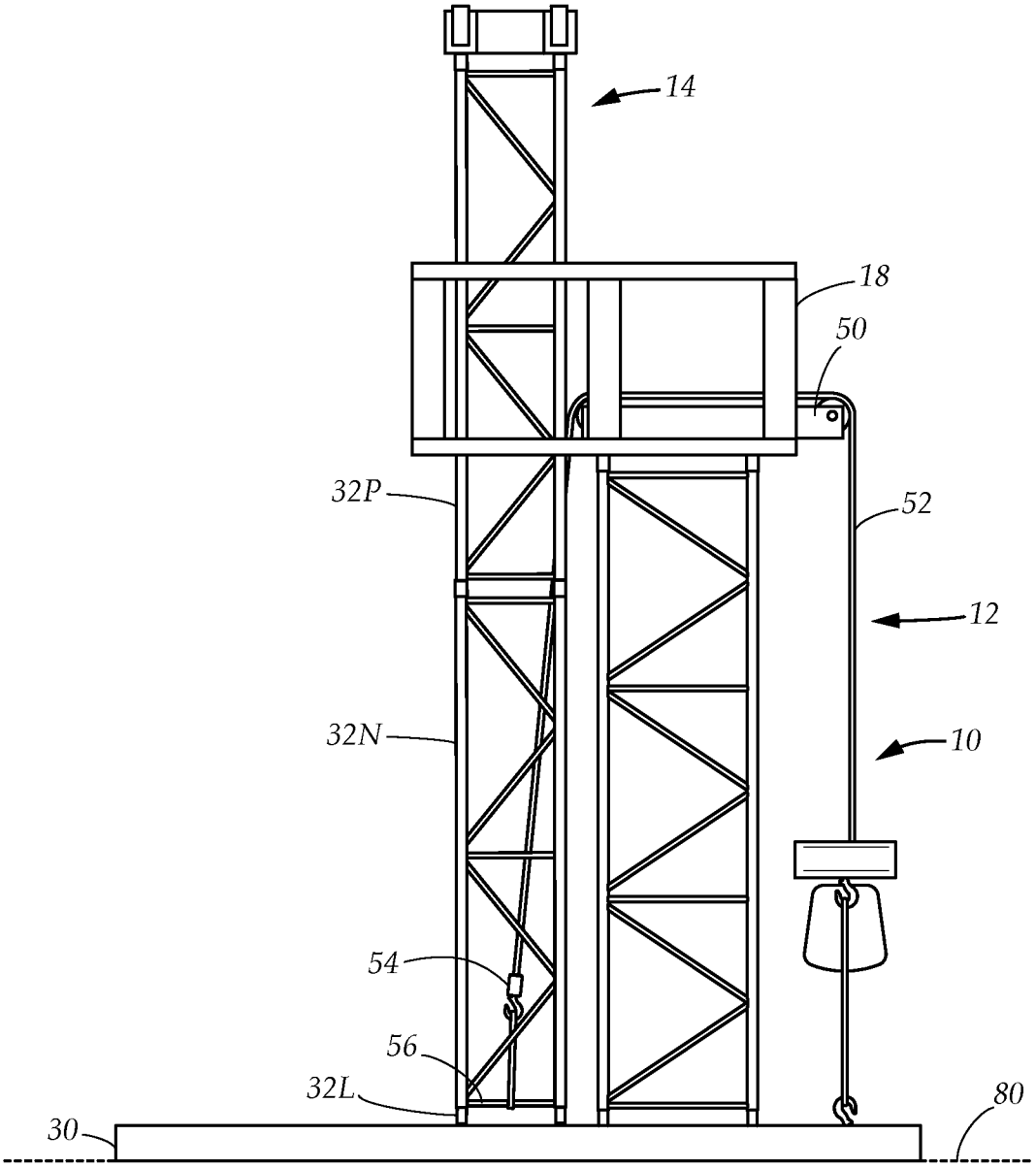
FIG. 9 is a diagrammatical side view of the tower feeding system in the grounded position, showing the attachment mechanism being transferred to the lowermost tower section, in accordance with an embodiment in the present disclosure.
Figure 10:
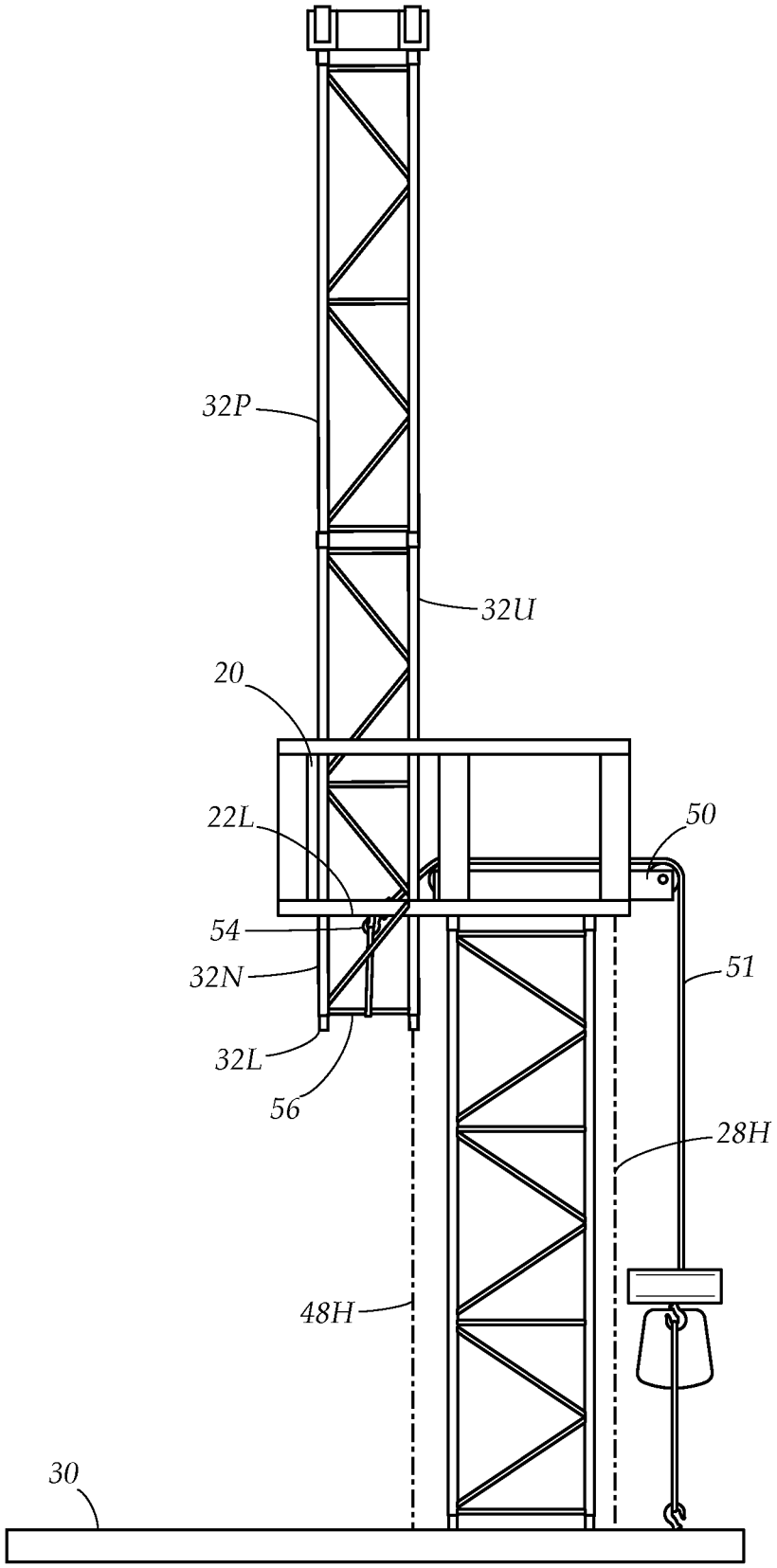
FIG. 10 is a diagrammatical side view of the self-building tower, showing the modular tower being raised upwardly to expose the section lower end of the lowermost tower section, in accordance with an embodiment in the present disclosure.

Turning to FIG. 9 while also referring to FIGS. 4A-5, once the additional tower section 32N has been attached to the preceding tower section 32P, the hoist mechanism 50 lowers the modular tower 14 to a grounded position whereby the section lower end 32L of the additional tower section 32N rests upon the supporting surface, such as the tower base 30. Furthermore, in certain embodiments, instead of lifting the additional tower section 32N to engage with the preceding tower section 32P, the preceding tower section 32P may instead be lowered to engage with the section upper end 32U of the additional tower section 32N, thus simultaneously placing the modular tower 14 in the grounded position. Once the modular tower 14 is in the grounded position, the modular tower 14 is no longer suspended by the hoist mechanism 50. The attachment mechanism 54 may therefore be removed from the hoist attachment point 56 of the preceding tower section 32P and be attached to the hoist attachment point 56 of the additional tower section 32N. Referring to FIG. 10 while continuing to refer to FIG. 9, the hoist mechanism 50 may then lift the modular tower 14 until the section upper end 32U of the additional tower section 32N passes through the feeder aperture 20 and is temporarily fixed therein, whereby the additional tower section 32N takes the place of the preceding tower section 32P to become the new preceding tower section 32P, thus allowing additional tower sections 32N to be incorporated into the modular tower 14.

Figure 11:
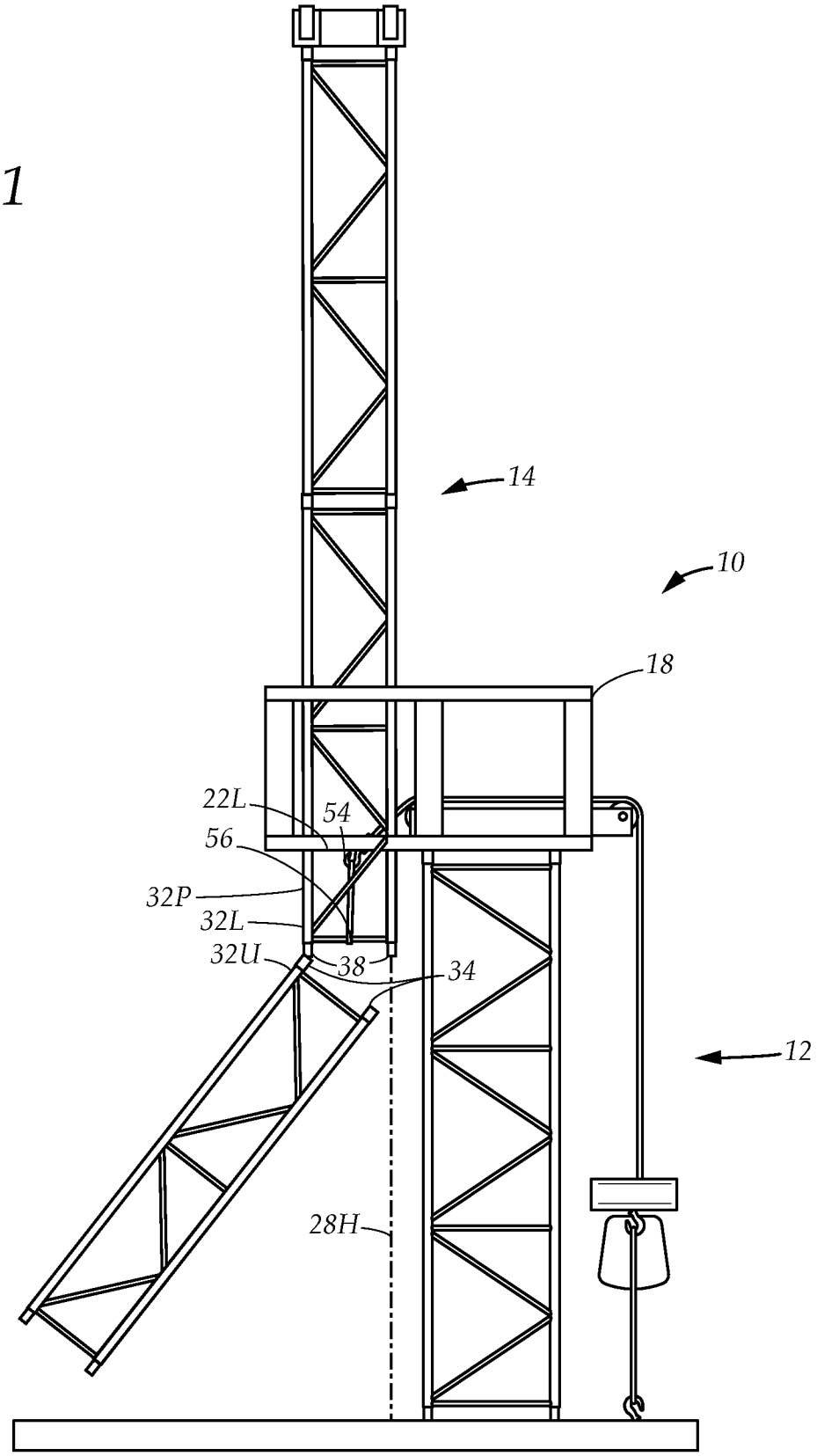
FIG. 11 is a diagrammatical side view of the self-building tower, showing a new additional tower section being attached to the lowermost tower section, in accordance with an embodiment in the present disclosure.
Figure 12:
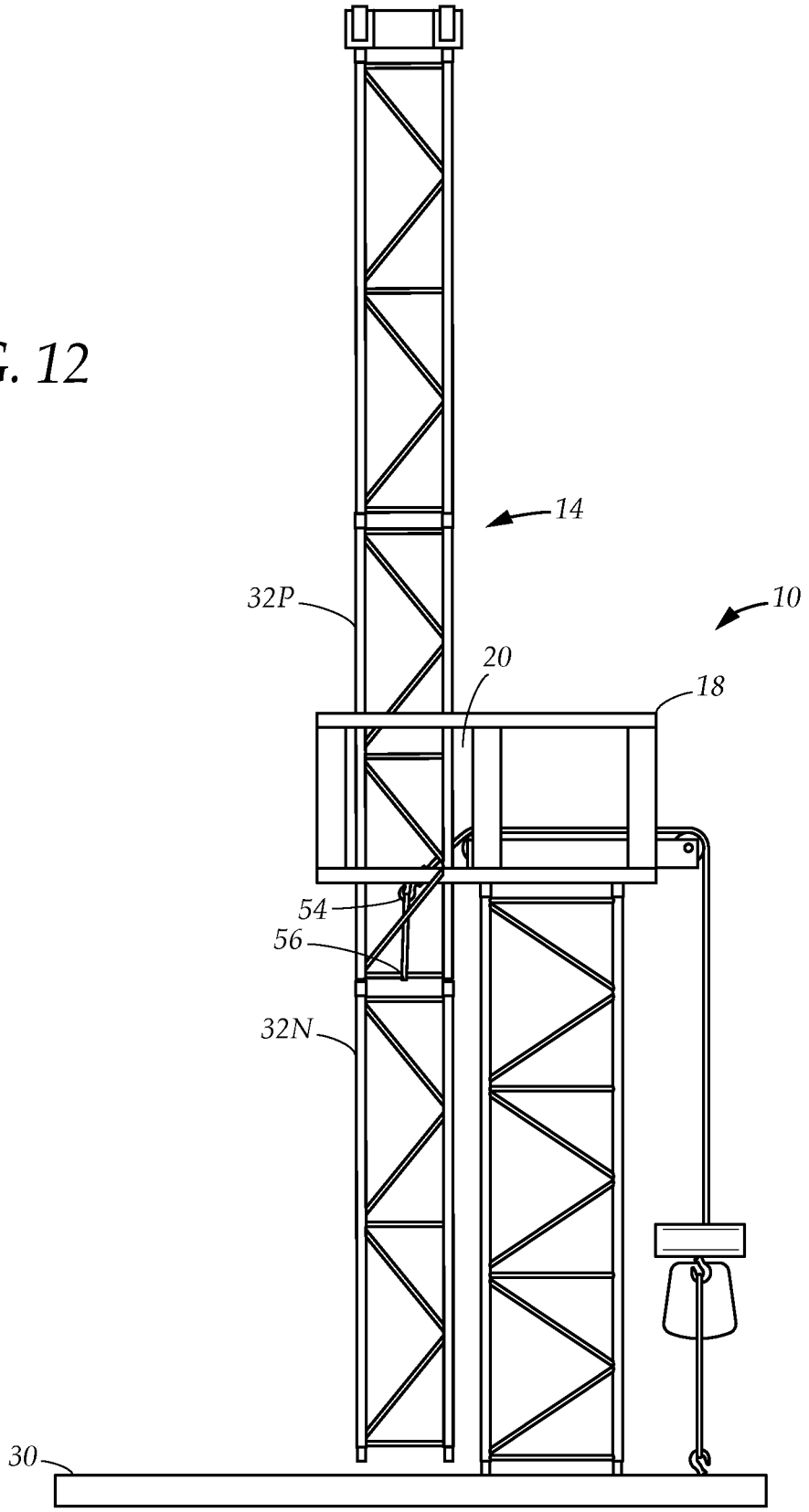
FIG. 12 is a diagrammatical side view of the self-building tower, showing the modular tower in the suspended position following the attachment of the new additional tower section to the lowermost tower section, in accordance with an embodiment in the present disclosure.
Figure 13:
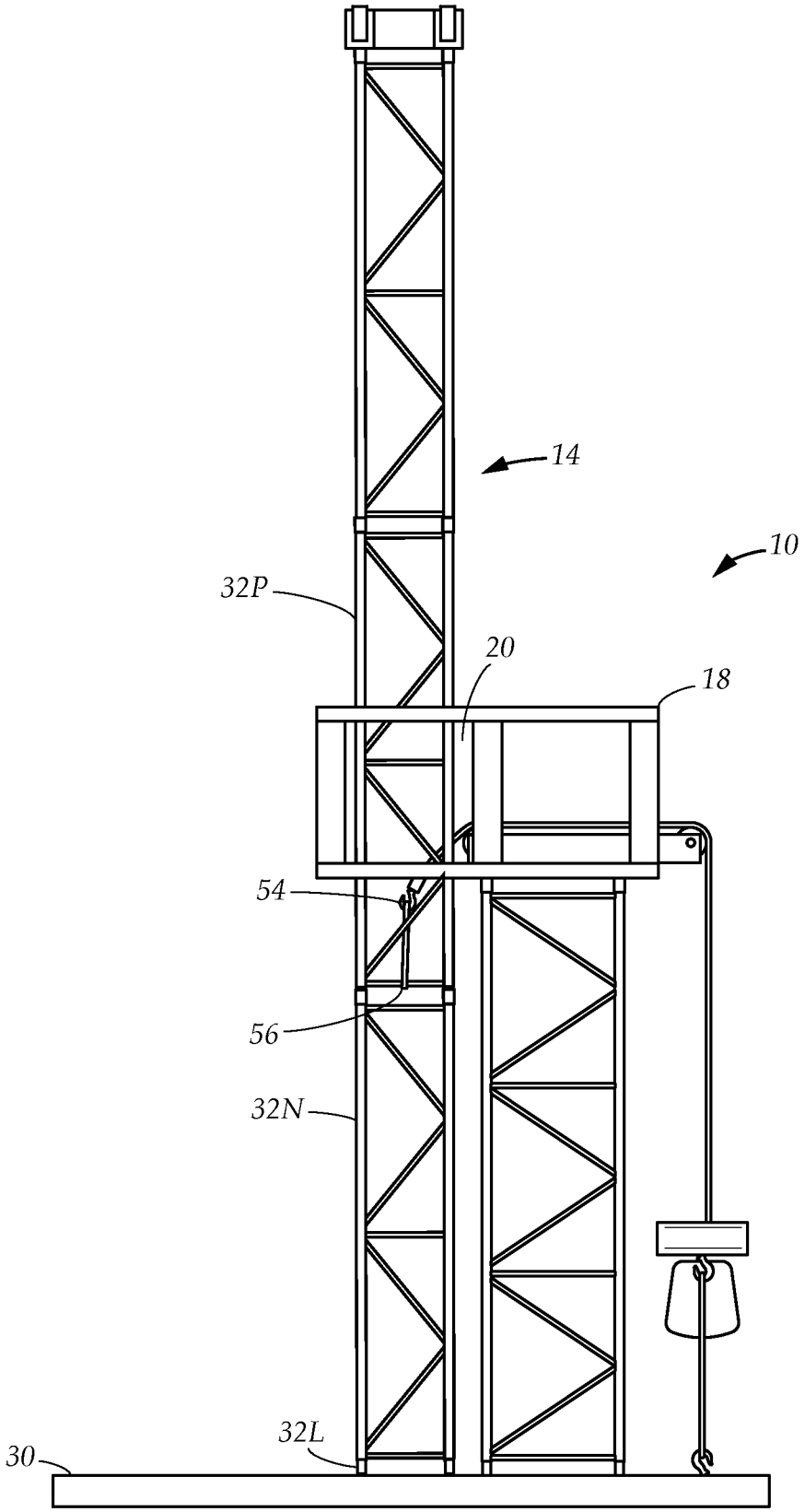
FIG. 13 is a diagrammatical side view of the self-building tower, showing the modular tower in the grounded position with the attachment mechanism being transferred to the lowermost tower section, in accordance with an embodiment in the present disclosure.
Figure 14:
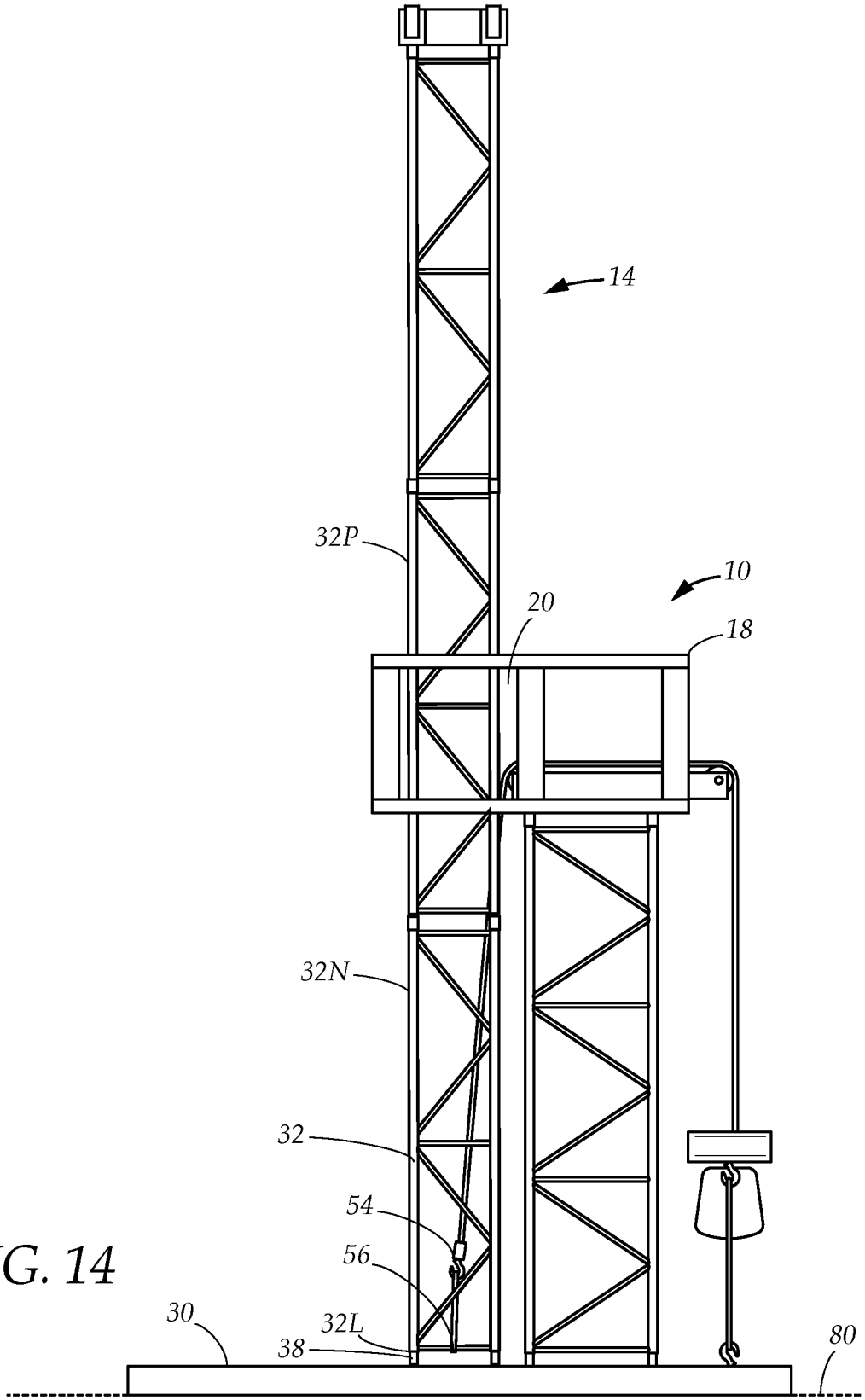
FIG. 14 is a diagrammatical side view of the self-building tower, showing the attachment mechanism being transferred to the lowermost tower section, in accordance with an embodiment in the present disclosure.
Figure 15:
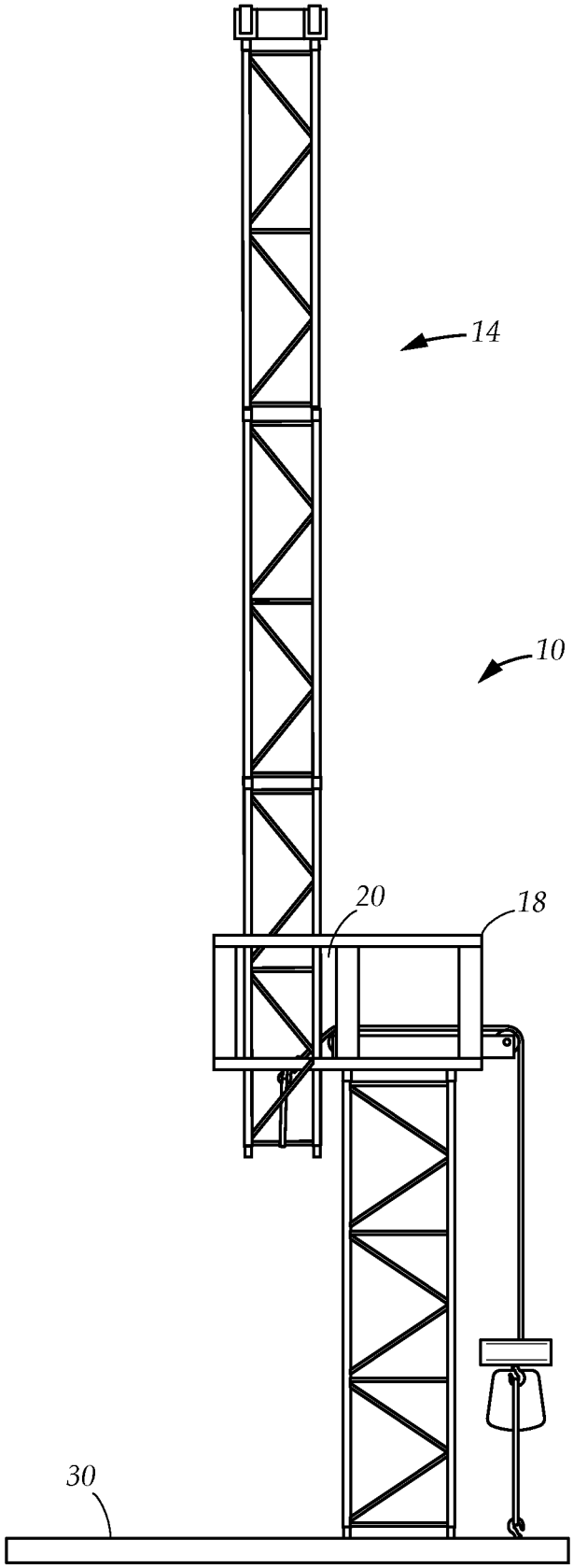
FIG. 15 is a diagrammatical side view of the self-building tower, showing the modular tower being raised upwardly to allow another additional tower section to be attached to the lowermost tower section, in accordance with an embodiment in the present disclosure.

Turning now to FIGS. 11-12, the assembly of the modular tower 14 continues, as a new additional tower section 32N is aligned with the section lower end 32L of the preceding tower section 32P while the modular tower 14 is in the suspended position, allowing the upper end attachment points 34 of the additional tower section 32N and the lower end attachment points 38 of the preceding tower section 32P to be secured together. Referring to FIG. 13, the modular tower 14 is then placed in the grounded position, whereby the section lower end 32L of the additional tower section 32N rests upon the tower base 30. Next, as shown in FIG. 14, the attachment mechanism 54 is detached from the preceding tower section 32P and is reattached to the hoist attachment point 56 of the additional tower section 32N. Turning to FIG. 15 while also referring to FIG. 14, the modular tower 14 may once again be placed in the suspended position to allow assembly of the modular tower 14 to continue. If no additional tower sections 32N remain to be incorporated into the modular tower 14, the assembly process is completed, and the modular tower 14 may remain in the grounded position. The section lower end 32L of the lowermost tower section 32 within the modular tower 14 may be further secured to the tower base 30 or the horizontal surface 80 as appropriate. Note that in certain embodiments, the lowermost tower section 32 within the modular tower 14 is not adapted to attach to any additional tower sections 32N and may therefore lack lower end attachment points 38. Note that the modular tower 14 may be disassembled by simply reversing the assembly procedure as described herein.

Figure 4B:
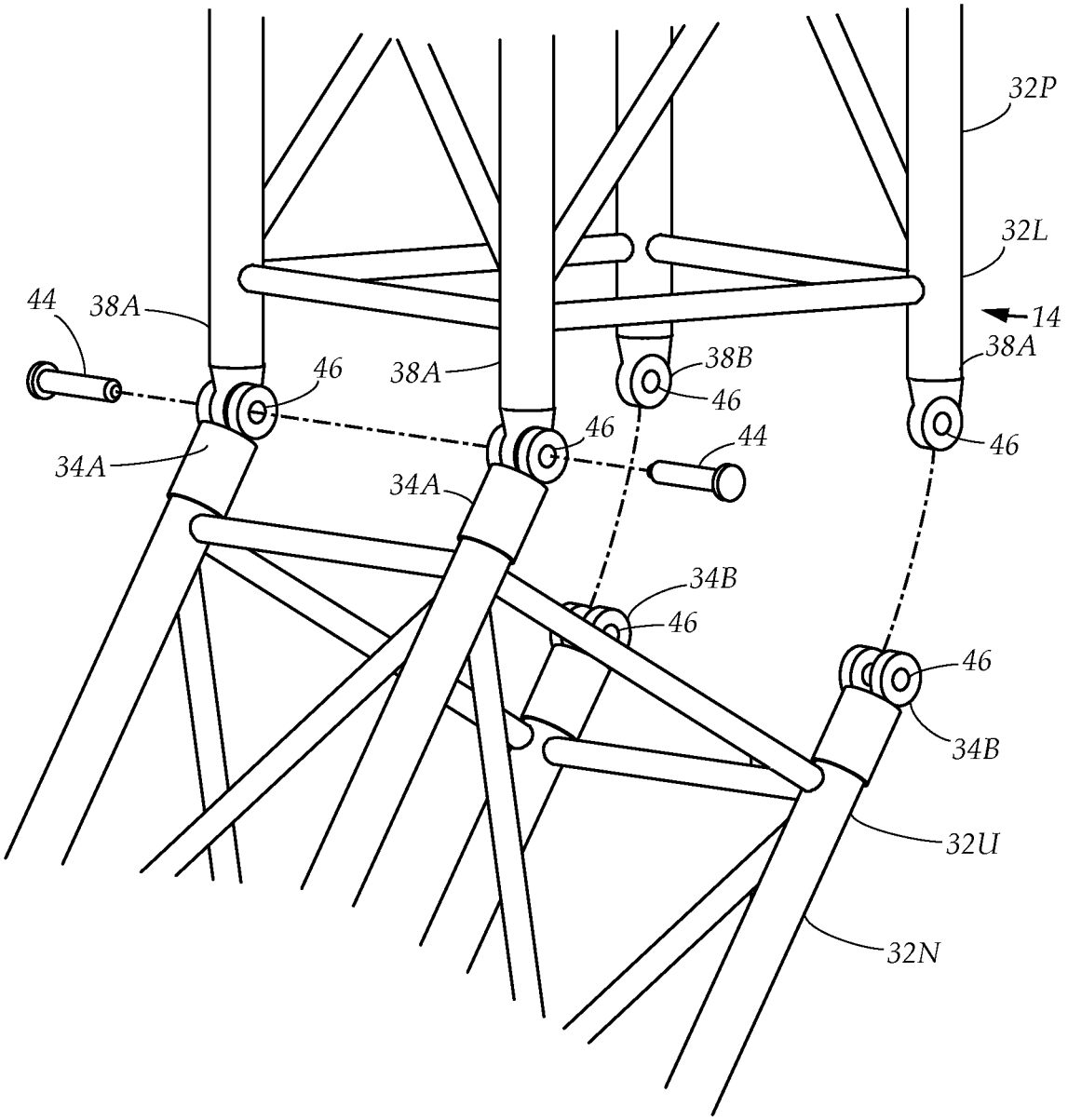
FIG. 4B is a diagrammatical perspective view of two tower sections joined together to form a hinged connection, in accordance with an embodiment in the present disclosure.
Figure 4C:
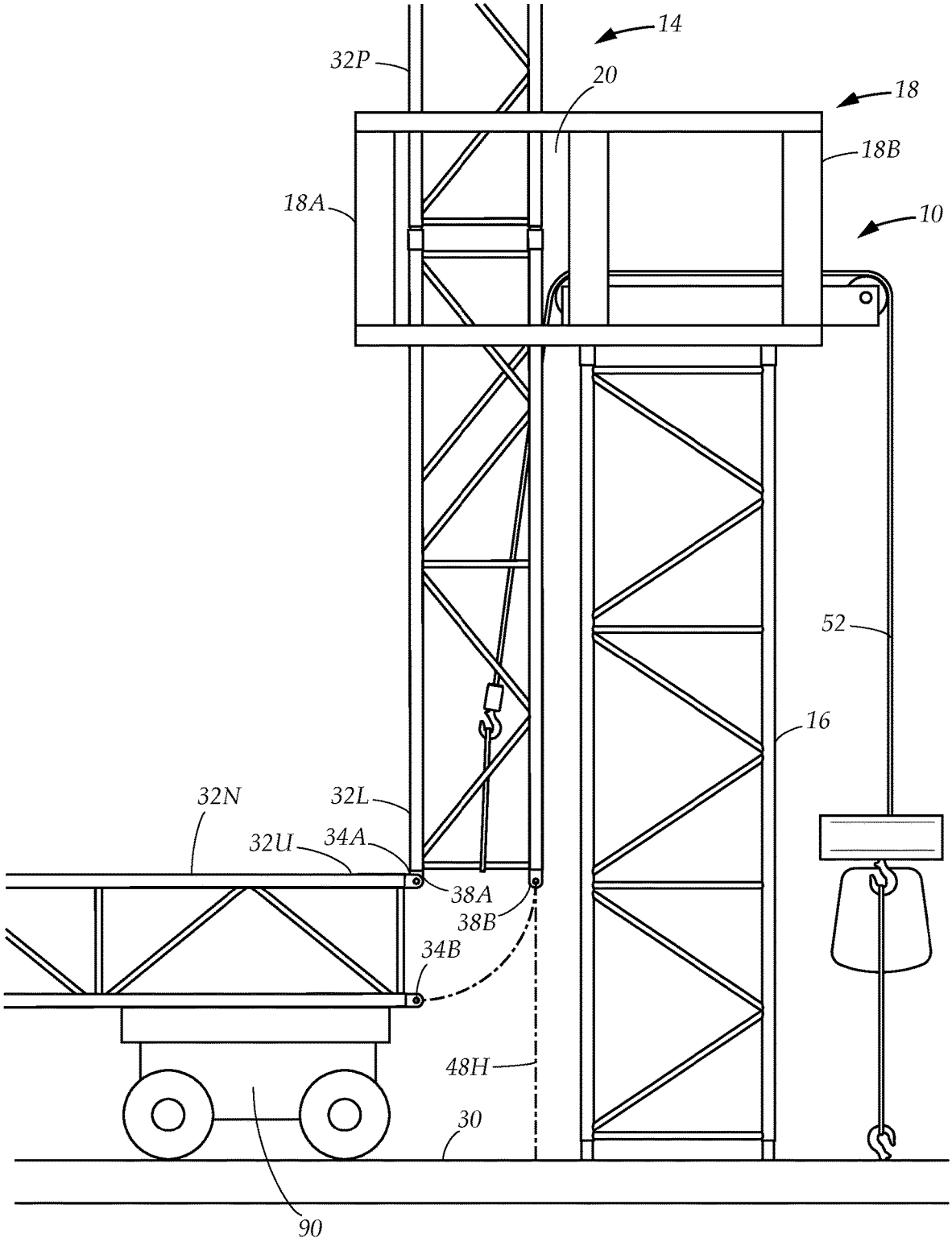
FIG. 4C is a diagrammatical side view of the additional tower resting in a horizontal position upon a movable support platform while being attached to the preceding tower section, in accordance with an embodiment in the present disclosure

Turning to FIGS. 4B and 4C, while also referring to FIG. 1, in an alternate embodiment, the tower sections 32 may be joined to each other in a hinged configuration. The upper end attachment points 34 may comprise one or more upper end hinged attachment points 34A and one or more upper end inner attachment points 34B, while the lower end attachment points 38 may comprise one or more lower end hinged attachment points 38A and one or more lower end inner attachment points 38B. When the preceding tower section 32P is positioned within the feeder aperture 20, the one or more lower end inner attachment points 38B may be oriented towards the support column 16 and/or the feeder sleeve block second end 18B, while the one or more lower end hinged attachment points 38A are oriented towards the feeder sleeve block first end 18A. The one or more upper end hinged attachment points 34A of the additional tower section 32N are adapted to engage with the lower end hinged attachment points 38A to form a hinged connection, allowing the additional tower section 32N to pivot about the hinged connection until the additional tower section 32N is perpendicular to the horizontal surface 80. In a preferred embodiment, the hinged connection may cause the second lower end 32L of the additional tower section 32N to pivot either towards or away from the support column 16. In one embodiment, the upper and lower end hinged attachment points 34A, 38A are configured with attachment holes 46 and an attachment pin 44, and join together to form a pin hinge. As the additional tower section 32N pivots towards the support column 16, the upper and lower end inner attachment points 34B, 38B are adapted to lock together, such as through the use of attachment holes 46 and attachment pins 44, to securely attach the section upper end 32U of the additional tower section 32N to the section lower end 32L of the preceding tower section 32P. Note that other hinged means may be employed to achieve the hinged connection, as will be apparent to a person of ordinary skill in the art in the field of the invention. In one embodiment where the tower sections 32 are rectangular in cross sectional shape, each tower section may have two upper end hinged attachment points 34A, two upper end inner attachment points 34B, two lower end hinged attachment points 38A, and two lower end inner attachment points 38B. Alternatively, where the tower sections 32 are triangular in cross sectional shape, each tower section may have two upper and lower end hinged attachment points 34A, 38A, and one upper and lower end attachment points 34, 38, or vice versa. Note that other cross sectional shapes may be achieved in accordance with the principles of the present disclosure, as will be apparent to a person of ordinary skill in the art in the field of the invention.

The employment of the hinged configuration simplifies the assembly of the modular tower 14 by only requiring the upper and lower end hinged attachment points 34A, 38A to be aligned, as the pivoting motion of the tower sections 32 about the hinged connection will automatically guide the engagement of the upper and lower end inner attachment points 34B, 38B. Furthermore, the additional tower section 32N can be attached to the preceding tower section 32P without the need to perpendicularly orient the additional tower section 32N in relation to the tower base 30 prior to attaching the additional tower section 32N to the preceding tower section 32P. For example, the additional tower section 32N may be placed in an angled position relative to the preceding tower section 32P and the modular tower 14, with the upper end hinged attachment points 34A in alignment with the lower end hinged attachment points 38A of the preceding tower section 32P. In certain embodiments, the additional tower section 32N may be placed in a substantially horizontal position relative to the tower base 30 and perpendicular to the preceding tower section 32P, with the section upper end 32U of the additional tower section 32N pointing towards the support column 16. The upper end hinged attachment points 34A are oriented upwardly away from the tower base 30, allowing the upper end hinged attachment points 34A to engage with the lower end hinged attachment points 38A of the preceding tower section 32P. In some embodiments, the additional tower section 32N may rest in the horizontal position on a movable support platform 90, such as a portable cart or dolly, to reduce the amount of manual lifting and handling required to assemble the modular tower 14. Alternatively, the additional tower section 32N may be positioned to rest directly upon the tower base 30 or horizontal surface 80.

Referring to FIGS. 7 and 8 while continuing to refer to refer to FIGS. 4A-B, once the upper and lower end hinged attachment points 34A, 38A are securely engaged, the preceding tower section 32P may be raised using the hoist mechanism 50, simultaneously lifting the section upper end 32U of the additional tower section 32N away from the tower base 30, and causing the section lower end 32L to pivot towards the support column 16 to bring the upper and lower end inner attachment points 34B, 38B into engagement. The modular tower 14 may then be placed in the grounded position, and the attachment mechanism 54 may be transferred from the preceding tower section 32P to the additional tower section 32N. Referring to FIG. 1 and FIG. 4B-C, in certain embodiments, it is unnecessary to raise the additional tower section 32N in order to attach it to the preceding tower section 32P, as the preceding tower section 32P may be lowered to allow the lower end hinged attachment points 38A of the preceding tower section 32P to engage with the upper end hinged attachment points 34A of the additional tower section 32N. Once the hinged connection is formed therebetween, the modular tower 14 may be raised upwardly via the hoist mechanism 50 along with the additional tower section 32N, allowing the additional tower section 32N to pivot about the hinged connection until the upper and lower inner attachment points 34B, 38B are engaged.

Referring to FIGS. 5-7, the feeder sleeve block 18 may be separated from the tower base 30 by a feeder sleeve height 28H. The feeder sleeve height 28H is greater than the tower section length 32H, as measured between the section upper and lower ends 32U, 32L, thus allowing the tower sections 32 to be maneuvered below the feeder sleeve block 18. For example, the tower section length 32H may be eight feet, while the feeder sleeve height 28H may be ten feet. Furthermore, when the modular tower 14 is in the suspended position, the section lower end 32L of the preceding tower section 32P is separated from the tower base 30 by a working interval 48H which allows the additional tower section 32N to be aligned with and attached to the preceding tower section 32P. The working interval 48H may be increased or decreased by alternatively raising or lowering the preceding tower section 32P within the feeder aperture 20. Referring to FIG. 4A while also referring to FIGS. 6-8, the working interval 48H may be greater than the tower section height 32H to allow the upper end attachment points 34 of the additional tower section 32N to be aligned with the lower end attachment points 38 of the preceding tower section 32P. Referring to FIGS. 4B-C while also referring to FIGS. 6-8, in the embodiment where the hinged configuration is employed, the working interval 48H may alternatively be less than the tower section height 32H to position the lower end hinged attachment points 38A of the preceding tower section 32P proximate to the upper end hinged attachment points 34A of the additional tower section 32N while the additional tower section 32N is in the horizontal position relative to the tower base 30.

Referring to FIG. 1, note that the tower base 30 may be formed in a variety of configurations as contemplated within the present disclosure. In one embodiment, the tower base 30 may be substantially planar and may extend across the horizontal surface 80 to allow the feeder aperture 20 to open directly over the tower base 30, thus allowing the tower sections 32 to be placed thereon, in addition to stabilizing the self-building tower 10 upon the horizontal surface 80. In other embodiments, the tower base 30 is not configured to allow the tower sections 32 to be placed thereon during the assembly of the modular tower 14, and the tower base 30 is only adapted to stabilize the self-building tower 10, and may instead be formed with one or more stabilizing legs, conventional truss base plates, ballasting means, and/or other mechanisms or devices known to a person of ordinary skill in the art in the field of the invention. In embodiments where the tower base 30 serves only to stabilize the self-building tower 10, or in those embodiments where the tower base 30 is omitted, a person of ordinary skill in the art will appreciate that the tower sections 32 are oriented in relation to the horizontal surface 80 instead of the tower base 30.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a self-building tower. The disclosure is illustrated by example in the drawing figures, and throughout the written description. It should be understood that numerous variations are possible, while adhering to the inventive concept. Such variations are contemplated as being a part of the present disclosure.

What is claimed is:

1. A method for deploying a self-building tower upon a horizontal surface, comprising:

providing a plurality of tower sections each having a section upper end and section lower end, the plurality of tower sections are adapted to be connectedly secured in a sequence to form a modular tower;

providing a tower feeding system having a feeder sleeve block and a support column, the feeder sleeve block has a feeder aperture adapted to allow each tower section to pass through the feeder sleeve block, the feeder aperture having an upper opening and a lower opening;

providing a hoist mechanism and a hoist line having an attachment mechanism, the hoist mechanism and hoist line are adapted to raise and lower the tower sections through the feeder aperture;

elevating the feeder sleeve block above the horizontal surface using the support column, orienting the lower opening towards the horizontal surface, and orienting the upper opening away from the horizontal surface;

initiating the sequence of tower sections by positioning one of the tower sections below the feeder sleeve block;

upwardly inserting the upper end of one of the tower sections into the feeder aperture via the lower opening;

attaching the attachment mechanism to the tower section;

raising the tower section using the hoist mechanism;

suspending the tower section within the feeder aperture;

positioning an additional tower section from the plurality of tower sections below the tower section which is suspended within the feeder aperture;

connecting the section upper end of the additional tower section to the section lower end of the tower section which is suspended within the feeder aperture, whereby the additional tower section becomes the lowermost tower section within the plurality of tower sections that form the modular tower;

detaching the attachment mechanism of the hoist line from the tower section preceding the lowermost tower section, and reattaching the attachment mechanism to the lowermost tower section;

lifting the modular tower through the feeder aperture using the hoist mechanism;

suspending the lowermost tower section within the feeder aperture;

positioning a new additional tower section from the plurality of tower sections below the lowermost tower section; and connecting the section upper end of the new additional tower section to the section lower end of the lowermost tower section.

2. The method as described in claim 1, wherein:

the step of detaching the attachment mechanism of the hoist line from the suspended tower section is preceded by the step of placing the modular tower in a grounded position by lowering the modular tower using the hoist mechanism until the lower end of the lowermost tower section rests upon a supporting surface.

3. The method as described in claim 2, wherein:

the section upper end of each tower section has one or more upper end hinged attachment points and one or more upper end inner attachment points, and the section lower end of each tower section has one or more lower end hinged attachment points and one or more lower end inner attachment points;

the step of suspending the tower section within the feeder aperture further comprises supporting the modular tower in a position perpendicular to the horizontal surface;

the step of connecting the section upper end of the additional tower section further comprises engaging the upper end hinged attachment points of the additional tower section to the lower end hinged attachment points of the suspended tower section to create a hinged connection between the additional tower section and the suspended tower section, pivoting the additional tower section about the hinged connection until the upper end inner attachment points of the additional tower section engage with the lower end inner attachment points of the lowermost tower section and the additional tower section is perpendicular to the horizontal surface; and the step of connecting the section upper end of the new additional tower section to the section lower end of the lowermost tower section further comprises engaging the upper end hinged attachment points of the new additional tower section to the lower end hinged attachment points of the lowermost tower section to create a hinged connection between the new additional tower section and the lowermost tower section, pivoting the new additional tower section about the hinged connection until the upper end inner attachment points of the new additional tower section engage with the lower end inner attachment points of the lowermost tower section and the new additional tower section is perpendicular to the horizontal surface.

4. The method as described in claim 3, wherein:

the step of positioning an additional tower section from the plurality of tower sections below the suspended tower section further comprises placing the additional tower section at an angle in relation to the modular tower; and the step of positioning a new additional tower section from the plurality of tower sections below the lowermost tower section further comprises placing the new additional tower section at an angle in relation to the modular tower.

5. The method as described in claim 4, wherein:

the step of providing a hoist mechanism is followed by the step of providing a tower mounted hoist mechanism adapted to raise a load;

the step of raising the tower section using the hoist mechanism further comprises raising the tower section until the section upper end of the tower section projects upwardly through the upper opening of the feeder sleeve block; and the step of suspending the tower section within the feeder aperture is followed by the step of attaching the tower mounted hoist mechanism to the section upper end of the tower section.

* * * * *